US006318613B1

(12) United States Patent
Underhill

(10) Patent No.: US 6,318,613 B1
(45) Date of Patent: Nov. 20, 2001

(54) CARRYING POUCH ATTACHABLE TO GARMENTS

(76) Inventor: Annette K. Underhill, P.O. Box 600, Russellville, AR (US) 72811

( * ) Notice: Subject to any disclaimer, the term of this patent is extended or adjusted under 35 U.S.C. 154(b) by 0 days.

(21) Appl. No.: 09/510,391

(22) Filed: Feb. 22, 2000

(51) Int. Cl.[7] ..... A45C 1/04

(52) U.S. Cl. ..... 224/587; 224/235; 224/623; 224/675; 224/901.4; 224/901.6; 2/247; 150/134; 450/89

(58) Field of Search ..... 224/191, 235, 224/240, 587, 623, 649, 675, 901.4, 901.6; 2/247; 150/134; 450/89

(56) References Cited

U.S. PATENT DOCUMENTS

| | | | | |
|---|---|---|---|---|
| D. 241,189 | | 8/1976 | Clark . | |
| 2,492,852 | | 12/1949 | Harvey . | |
| 2,503,847 | | 4/1950 | Shanahan . | |
| 2,593,711 | | 4/1952 | Weatherly . | |
| 2,624,881 | | 1/1953 | Lee . | |
| 3,078,852 | | 2/1963 | Stapleton . | |
| 4,079,767 | * | 3/1978 | Howard | 150/3 |
| 4,815,510 | | 3/1989 | Edelist . | |
| 5,067,178 | | 11/1991 | Katchika . | |
| 5,170,917 | * | 12/1992 | Tourigny | 224/211 |
| 5,496,205 | | 3/1996 | Lee . | |
| 5,544,745 | * | 8/1996 | Famorca | 206/320 |
| 5,573,441 | | 11/1996 | Smith . | |
| 5,588,571 | * | 12/1996 | Mazzo | 224/222 |
| 6,182,878 | * | 2/2001 | Racca | 224/605 |

* cited by examiner

*Primary Examiner*—Stephen K. Cronin
(74) *Attorney, Agent, or Firm*—Frank J. Catalano

(57) ABSTRACT

A pouch attachable to a garment to store objects of credit card length and width has a container with front and back walls fixed to each other along bottom and opposite side edges to define a compartment sized to receive and hold, in a substantially immobile condition, several of the objects when they are stacked face-to-face and inserted through an open top edge of the container. Mating pieces of hook-and-loop material seal the open top edge to secure the objects in the container. A strap fixed at one of its ends to a back face of the container back wall proximate one of its edges extends across the container back face to its free end at a point proximate another of its edges. A segment of hook-and loop material is fixed along its entire length to the entire length of the front face of the strap. A mating segment of hook-and-loop material is fixed along its entire length to the back face of the container back wall between the fixed end of the strap and the point at the free end of the strap. When the segments of hook-and-loop material are mated with a segment of the garment disposed between a portion of their lengths, the container is immobilized in relation to the garment The container side edges are preferably arcuate so as to approximately conform to cleavage between a woman's breasts and further immobilize the pouch when it is used between the cups of a woman's bra.

19 Claims, 3 Drawing Sheets

CARRYING POUCH ATTACHABLE TO GARMENTS

BACKGROUND OF THE INVENTION

This invention relates generally to carrying pouches for credit cards, folded money, identification cards and similarly sized materials and more particularly concerns a pouch attachable to part of a garment, such as the center section or strap of a woman's bra or a similarly shaped portion of any garment.

A variety of pouches have been designed for use in carrying credit cards, folding money, identification cards and the like which connect to, or are part of, a garment and are oriented so as to be concealed, yet accessible. Generally, their bulk, shape and orientation on the garment are mutually exclusive of comfort and purpose, those that work efficiently being uncomfortable and those that are comfortable being inefficient. They are all generally mobile in that, though attached to the garment, they are not held in secure orientation in relation to the garment. They are, therefore, generally difficult to open and close and to fill and empty. Most of them are designed to be located between the garment to which they are attached and the body of the user. This in turn results in the absorption of body moisture by the pouch and eventually by its contents or, if the pouch material is nonabsorbent, in skin irritation and discomfort to the user. Furthermore, because of their orientation between the garment and the body, they are relatively inaccessible and therefore inconvenient.

It is, therefore, an object of this invention to provide a carrying pouch which is as small as possible while accommodating credit card size contents. Another object of this invention is to provide a carrying pouch which has a compartment oriented with respect to its fastener for comfort and convenience of the user. A further object of this invention is to provide a carrying pouch which, when attached to a garment, is immobilized in its orientation. Yet another object of this invention is to provide a carrying pouch which, when attached to the user's garment, is easily accessed. It is also an object of this invention to provide a carrying pouch which, when attached to the user's garment, is easily opened and closed. Still another object of this invention is to provide a carrying pouch which, when attached to the user's garment, is easily filled and emptied. An additional object of this invention is to provide a carrying pouch which is not positioned between the garment to which it is attached and the skin of the wearer. And it is an object of this invention to provide a carrying pouch which does not absorb or transmit body moisture to its contents, yet does not cause irritation and discomfort to the user.

SUMMARY OF THE INVENTION

In accordance with the invention, a pouch attachable to a garment or other item of wearing apparel is provided for storing objects of credit card length and width. The pouch includes a container and a fastening mechanism for securing the container to the garment or other item of wearing apparel. The container has front and back walls fixed to each other along bottom and opposite side edges. The walls define a compartment sized to receive and hold, in a substantially immobile condition, a plurality of the objects when they are stacked face-to-face and inserted, preferably in a lengthwise direction, through an open top edge of the container. A mechanism, such as a button, zipper or, preferably, mating pieces of hook-and-loop material, is provided for sealing at least a portion of the open top edge so as to secure the objects inserted into the container. A strap fixed at one of its ends to a back face of the container back wall proximate one of its edges extends across the container back face to its free end at a point proximate another of its edges. A segment of hook-and loop material is fixed along its entire length to the entire length of the front face of the strap. A mating segment of hook-and-loop material is fixed along its entire length to the back face of the container back wall between the fixed end of the strap and the point at the free end of the strap. When the segments of hook-and-loop material are mated with a segment of the garment or other wearing apparel disposed between a portion of their lengths, the container is immobilized in relation to the garment or other item of wearing apparel.

Preferably, the strap fixed end is at approximately a midpoint of the top edge of the container and the free end is at approximately a midpoint of the bottom edge of the container with a pull tab extending from the free end of the strap. The sealing mechanism is preferably fixed proximate a midpoint of the top edge. The container side edges are preferably arcuate so as to approximately conform to cleavage between a woman's breasts and further immobilize the pouch when it used between the cups of a woman's bra. Preferably the back wall of the container has two layers of cloth with a layer of comparatively rigid material disposed between the cloth layers, a back layer of the two layers of cloth being moisture absorbent and a front layer of the two layers of cloth being impermeable to moisture. Preferably, the front wall of the container also has two layers of cloth, the front layer being decorative and the back layer being impermeable to moisture. This embodiment is specially suited for use on the center part of a woman's bra or a similar segment of other wearing apparel.

In an alternative embodiment, two parallel, spaced-apart straps extend from fixed ends at points on one of the side edges to free ends at points on another of the side edges in a direction parallel to the top and bottom edges. Each of the straps has a hook-and-loop segment cooperable with a mating hook-and-loop segment on the back face of container back wall. This embodiment is specially suited for use with the shoulder straps of an undergarment or similar segments of other wearing apparel.

BRIEF DESCRIPTION OF THE DRAWINGS

Other objects and advantages of the invention will become apparent upon reading the following detailed description and upon reference to the drawings in which.

Figure 5:
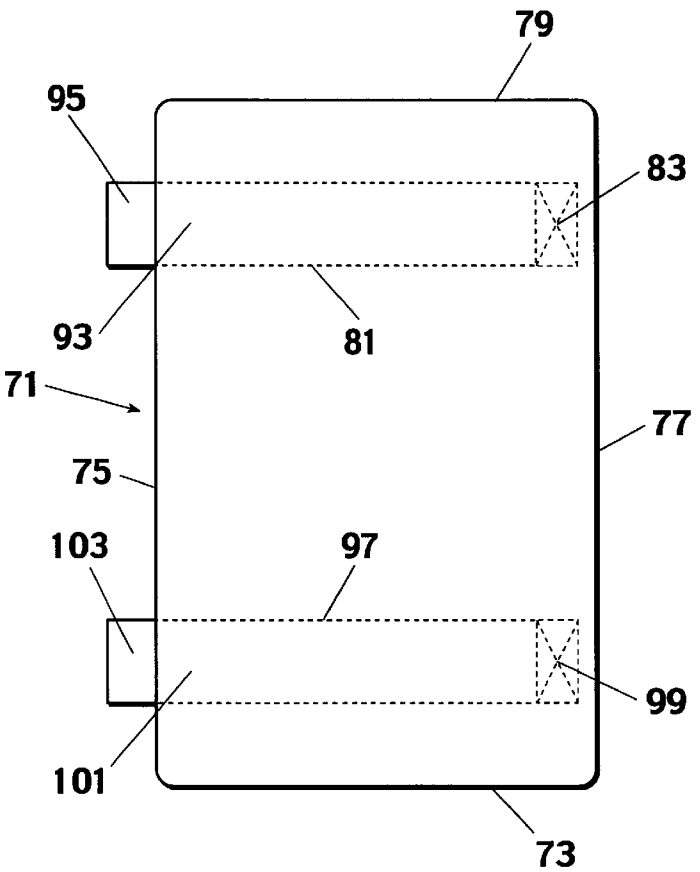
FIG. 5 is a front elevation view of another embodiment of the carrying pouch.

While the invention will be described in connection with preferred embodiments, it will be understood that it is not intended to limit the invention to these embodiments. On the contrary, it is intended to cover all alternatives, modifications and equivalents as may be included within the spirit and scope of the invention as defined by the appended claims.

DETAILED DESCRIPTION

Turning first to FIGS. 1 through 4, a single strap embodiment of the carrying pouch is illustrated. The pouch consists of a container 11 and a mechanism 13 for securing the container 11 to a garment or item of wearing apparel. The container 11 has a front wall 15 and a back wall 17 which are stitched or otherwise fastened together at a bottom edge 19 and side edges 21 and 23. The stitched edges 19, 21 and 23 define a compartment 25 sized to receive stacked objects such as identification, folding money or credit cards and the like folded into credit card size for insertion through an open top edge 27 of the container 11 into the compartment 25. As shown, the preferred fastening mechanism 13 consists of a strap 31 having its fixed end 33 fastened proximate one of the edges 19, 21, 23 or 27 to the back face of the back wall 17. As shown, the fixed end 33 of the strap 31 is fastened proximate the mid point of the open top edge of the container 11. The strap 31 extends across the back wall 17 of the container 11 to a free end 35 of the strap 31 at a point 37 proximate another edge 19, 21, 23 or 27 of the container 11. As shown, the strap 31 extends to approximately the midpoint of the bottom edge 19 of the container 11. As can best be seen in FIGS. 2–4, a segment of hook and loop material 39 is fastened to and extends for substantially the entire length of the front face of the strap 31. A mating segment 41 of hook and loop material is fastened to the back face of the back wall 17 and extends substantially fully across the back wall 17 of the container 11 and opposite the first segment 39. Preferably, the hook and loop segments 39 and 41 are fastened to the strap 31 and the back wall 17 of the container 11 by stitching. Thus, substantially the entire length of the strap 31 can be fastened to substantially the entire distance across the back wall 17 of the container 11. As shown, the free end 35 of the strap 31 can be extended beyond the perimeter of the container 11 so as to provide a pull tab 43 which the user can grip between the thumb and forefinger to manipulate the strap 31.

Figure 4:
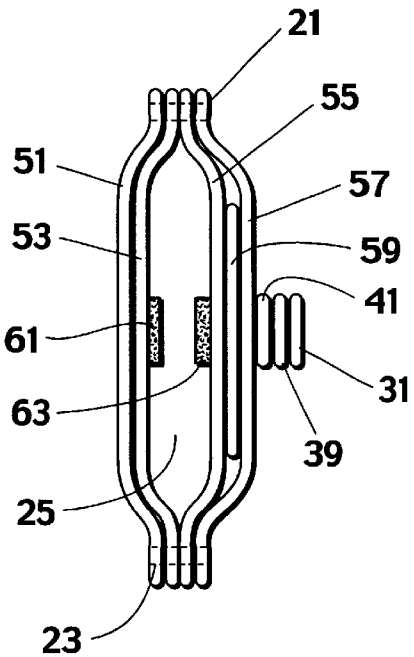
FIG. 4 is a cross-sectional view taken along the line 4—4 of FIG. 1.
Figure 3:
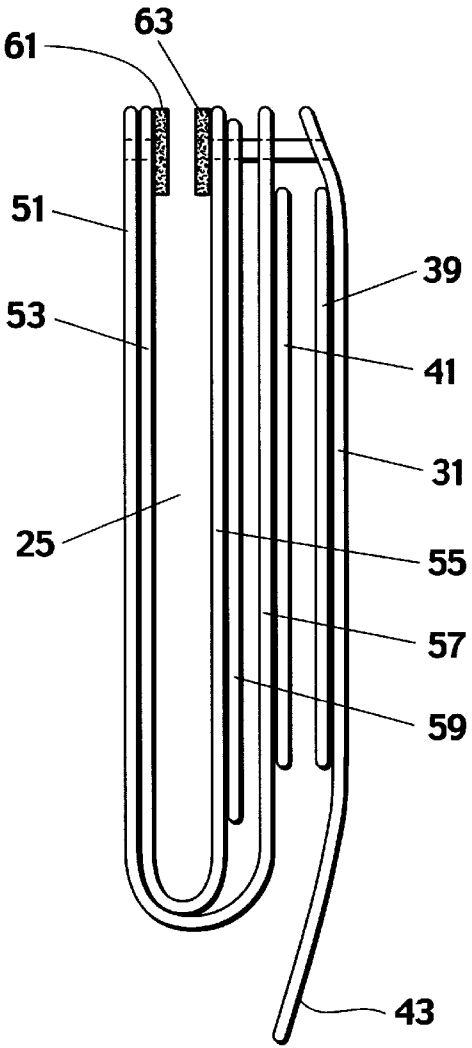
FIG. 3 is a cross-sectional view taken along the line 3—3 of FIG. 1.
Figure 2:
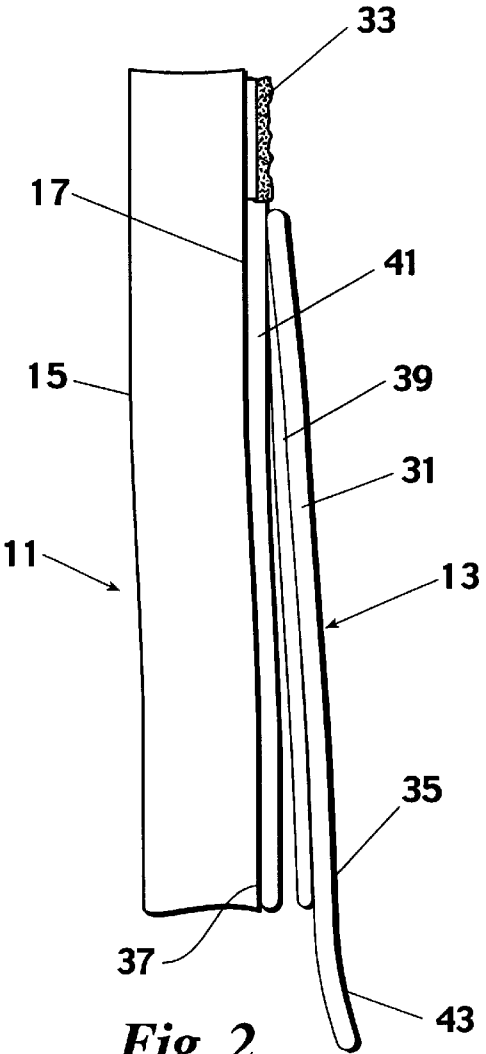
FIG. 2 is a side elevation view of the carrying pouch of FIG. 1.

Looking at FIGS. 3 and 4, the preferred construction of the pouch can be seen in greater detail. The front wall 15 consists of two layers of cloth, the front layer 51 being of decorative material and the back layer 53 being of material substantially impermeable to moisture. The back wall 17 of the container 11 consists of two layers of cloth, the front cloth 55 being substantially impermeable to moisture and the back layer 57 preferably being moisture absorbent though it may be impermeable to moisture. Between the two layers of cloth 55 and 57 in the back wall 17, an insert of comparatively rigid material 59 is disposed to help in maintaining the shape of the pouch and in preventing the pouch from collapsing. The cloth layers 51, 53, 55 and 57 are preferably secured together by stitching. As shown, the open top of the compartment 11 is sealable by mating pieces 61 and 63 of hook and loop material, preferably centered on the top edge 27 of the compartment 11 and stitched to the surfaces of the front and back walls 15 and 17 of the container 11.

Figure 6:
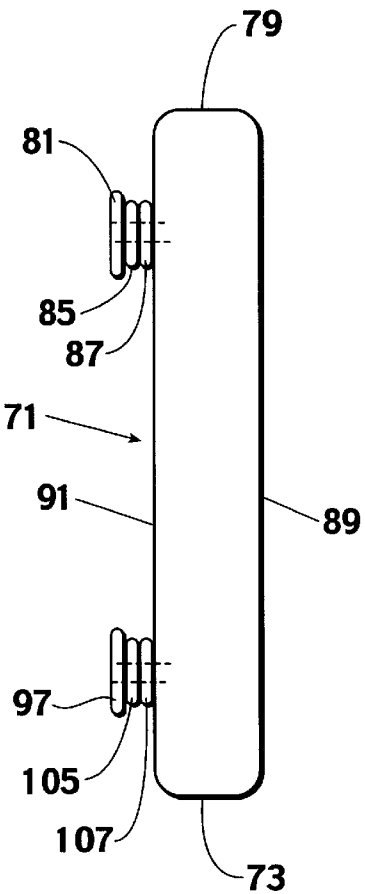
FIG. 6 is a side elevation view of the carrying pouch of FIG. 5.
Figure 1:
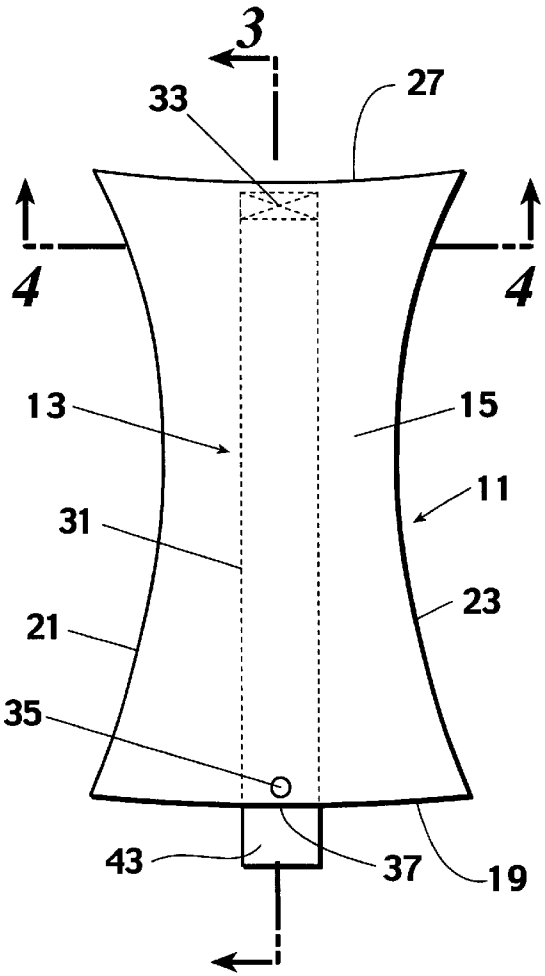
FIG. 1 is a front elevation view of one embodiment of the carrying pouch.

Turning to FIGS. 5 and 6, a two strap embodiment of the carrying pouch is illustrated. The container 71 is in all respects the same as the container 11 hereinbefore described, the differences between the single strap embodiment and the two strap embodiment of the pouch being in the fastening mechanism. As shown in FIG. 5, the container 71 has a bottom edge 73, side edges 75 and 77 and an open top edge 79. A first strap 81 is fixed at one end 83, preferably by stitching, to the back wall of the container 71 proximate one side edge 77 and extends across the back wall of the container 71 substantially parallel to the open top edge 79 to the opposite edge 75 of the container 71. Mating hook and loop segments 85 and 87 are secured, preferably by stitching, to the front face of the strap 81 and the back face of the back wall 91, respectively. The free end 93 of the strap 81 may be extended to form a pull tab 95 at the end of the strap 81. Similarly, a second strap 97 is fastened, preferably by stitching, at its fixed end 99 to the back wall 91 proximate one side edge 77 and extends across the back wall 91 parallel to the bottom edge 73 to the other side edge 75 of the container 71. The free end 101 of the strap 97 may be extended to form a pull tab 103 for manipulating the strap 97. The front face of the strap 97 and the back face of the back wall 91 support mating hook and loop segments 105 and 107, respectively, for securing the second strap 97 to the container 71. In the two strap embodiment, the straps 81 and 97 could be horizontal as shown or disposed at an angle, as long as the straps 81 and 97 extend substantially from one perimeter point of the container 71 to another perimeter point of the container 71 with mating segments of hook and loop material extending fully on the container 71 from one perimeter point to the other and extending fully on the straps 81 and 97 and matable with the straps 81 and 97 across the entire distance.

Figure 8:
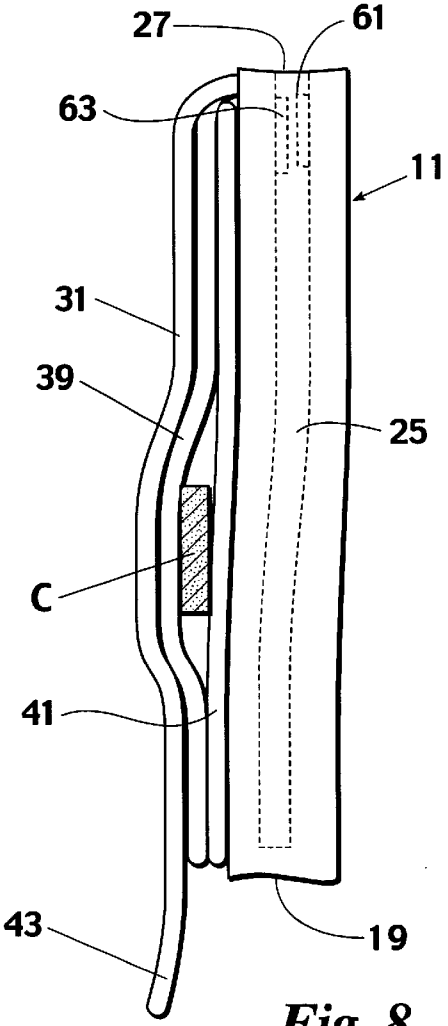
FIG. 8 is a cross-sectional view taken along the line 8—8 of FIG. 7.
Figure 7:
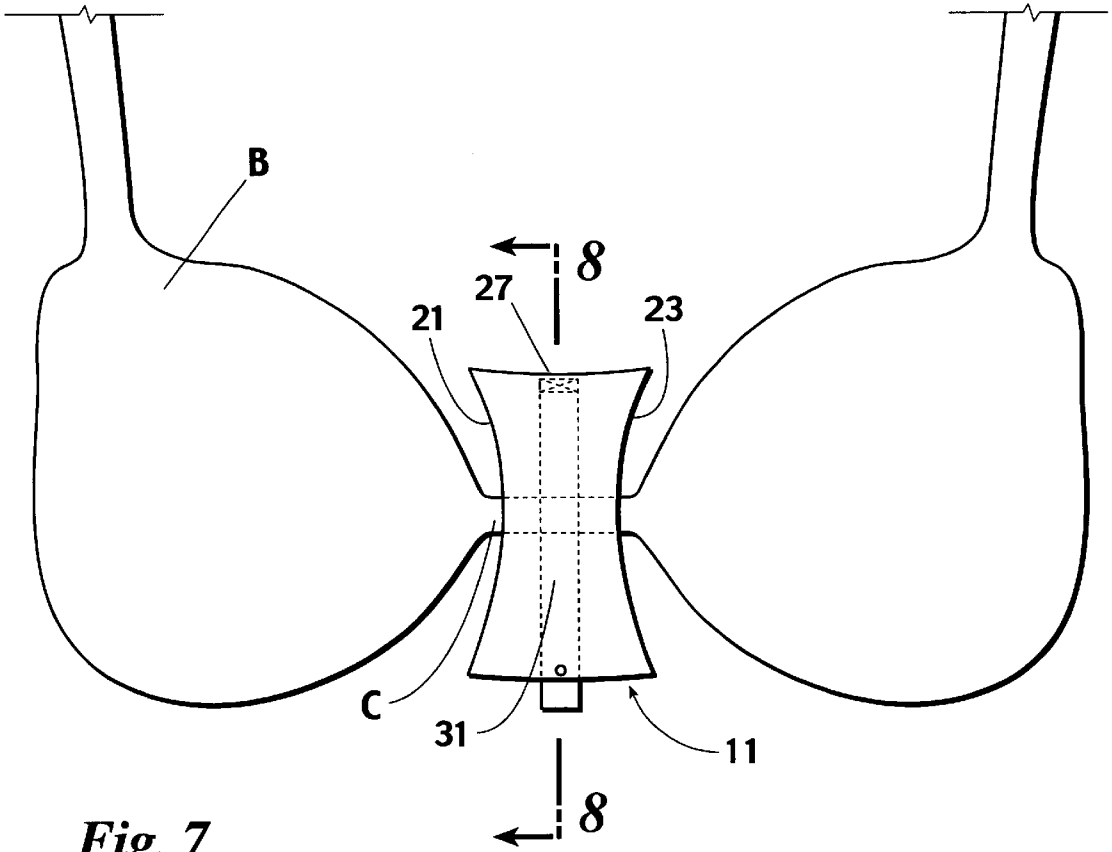
FIG. 7 is a front elevation view of the pouch of FIG. 1 attached to a garment.

Looking at FIGS. 7 and 8, the manner of using the carrying pouch is illustrated. As shown, the container 11 is to be secured to a garment segment such as the center portion C of a woman's bra B. The mating segments of hook and loop material 39 and 41 on the strap 31 and the back wall 17 of the container 11 are separated. The back face of the back wall 17 of the container 11 is laid against the front face of the center segment C of the bra B and the strap 31 is extended behind the center piece C of the bra B. The segments 39 and 41 of hook and loop material are then mated together along their entire length, except where contact between them is prohibited by the center piece C of the bra B. Thus, the pouch is substantially immobilized on the garment because the mating segments of hook and loop material 39 and 41 lock the pouch around the center piece C of the bra B. As shown, the sidewalls 21 and 23 of the container 11 are arcuate so as to conform to the cups of the bra B. This further assures the immobility of the pouch.

Thus, it is apparent that there has been provided, in accordance with the invention, a carrying pouch attachable to garments that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. For storing a plurality of objects of credit card length and width stacked face-to-face, a pouch attachable to a segment of a garment comprising a container having independent front and back walls fixed to each other along bottom and opposite side edges to define a compartment sized to receive and hold the plurality of objects inserted in a lengthwise direction through an open top edge thereof in substantially immobile condition therein, means for sealing at least a portion of said open top edge so as to secure the objects inserted therein, a strap fixed at one end thereof to a back face of said back wall proximate one of said edges of said container and extending across said back face to a free end of said strap at point proximate another of said edges, a segment of hook-and loop material fixed along its entire length to an entire length of a front face of said strap and a mating segment of hook-and-loop material fixed along its entire length to said back face of said container back wall between said strap fixed end and said point whereby, when said segments of hook-and-loop material are mated with the segment of the garment disposed therebetween over a portion of said lengths thereof, said container is immobilized in relation to the garment.

2. A pouch according to claim 1, said strap extending from said fixed end at approximately a midpoint of said top edge to said free end at approximately a midpoint of said bottom edge.

3. A pouch according to claim 1 further comprising a pull tab extending from said free end of said strap.

4. A pouch according to claim 1, said sealing means comprising mating pieces of hook-and-loop material, one of said pieces being fixed to a front face of said back wall and another of said pieces being fixed to a back face of said front wall.

5. A pouch according to claim 4, said pieces being fixed proximate a midpoint of said top edge.

6. A pouch according to claim 1, said strap extending from said fixed end at a point of one of said side edges to said free end at a point of another of said side edges.

7. A pouch according to claim 6, said strap extending in a direction parallel to said top and bottom edges.

8. A pouch according to claim 6, further comprising a second strap having second mating hook-and-loop segments cooperable therewith and with said back face of said container back wall, said second strap having different fixed and free end points than said first strap.

9. A pouch according to claim 8, said straps being in parallel spaced-apart relationship.

10. For storing a plurality of objects of credit card length and width stacked face-to-face, a pouch attachable to a bra comprising a container having front and back walls fixed to each other along bottom and opposite side edges to define a compartment sized to receive and hold the plurality of objects inserted in a lengthwise direction through an open top edge thereof in substantially immobile condition therein, said side edges being arcuate so as to approximately conform to cleavage between the cups of the bra, means for sealing at least a portion of said open top edge so as to secure the objects inserted therein, a strap fixed at one end thereof to a back face of said back wall proximate one of said edges of said container and extending across said back face to a free end of said strap at point proximate another of said edges, a segment of hook-and-loop material fixed along its entire length to an entire length of a front face of said strap and a mating segment of hook-and-loop material fixed along its entire length to said back face of said container back wall between said strap fixed end and said point whereby, when said segments of hook-and-loop material are mated with the segment of the garment disposed therebetween over a portion of said lengths thereof, said container is immobilized in relation to the garment.

11. For storing a plurality of objects of credit card length and width stacked face-to-face, a pouch attachable to a segment of a garment comprising a container having front and back walls fixed to each other along bottom and opposite side edges to define a compartment sized to receive and hold the plurality of objects inserted in a lengthwise direction through an open top edge thereof in substantially immobile condition therein, said back wall of said container comprising two layers of cloth, means for sealing at least a portion of said open top edge so as to secure the objects inserted therein, a strap fixed at one end thereof to a back face of said back wall proximate one of said edges of said container and extending across said back face to a free end of said strap at point proximate another of said edges, a segment of hook-and loop material fixed along its entire length to an entire length of a front face of said strap and a mating segment of hook-and-loop material fixed along its entire length to said back face of said container back wall between said strap fixed end and said point whereby, when said segments of hook-and-loop material are mated with the segment of the garment disposed therebetween over a portion of said lengths thereof, said container is immobilized in relation to the garment.

12. A pouch according to claim 11, said back wall further comprising a layer of material rigid in comparison to said cloth layers disposed therebetween.

13. A pouch according to claim 11, a back layer of said two layers of cloth being moisture absorbent.

14. A pouch according to claim 13, a front layer of said two layers of cloth being impermeable to moisture.

15. For storing a plurality of objects of credit card length and width stacked face-to-face, a pouch attachable to a segment of a garment comprising a container having front and back walls fixed to each other along bottom and opposite side edges to define a compartment sized to receive and hold the plurality of objects inserted in a lengthwise direction through an open top edge thereof in substantially immobile condition therein, said front wall of said container comprising two layers of cloth, means for sealing at least a portion of said open top edge so as to secure the objects inserted therein, a strap fixed at one end thereof to a back face of said back wall proximate one of said edges of said container and extending across said back face to a free end of said strap at point proximate another of said edges, a segment of hook-and loop material fixed along its entire length to an entire length of a front face of said strap and a mating segment of hook-and-loop material fixed along its entire length to said back face of said container back wall between said strap fixed end and said point whereby, when said segments of hook-and-loop material are mated with the segment of the garment disposed therebetween over a portion of said lengths thereof, said container is immobilized in relation to the garment.

16. A pouch according to claim 15, a front layer of said two layers of cloth being decorative.

17. A pouch according to claim 15, a back layer of said two layers of cloth being impermeable to moisture.

18. For storing a plurality of objects of credit card length and width stacked face-to-face, a pouch attachable to a segment of a garment comprising a container having independent front and back walls fixed to each other along bottom and opposite side edges to define a compartment sized to receive and hold the plurality of objects inserted through an open top edge thereof in substantially immobile condition therein, a strap fixed at one end thereof to a back face of said back wall proximate one of said edges of said container and extending across said back face to a free end of said strap at point proximate another of said edges, a segment of hook-and loop material fixed along its entire length to an entire length of a front face of said strap and a mating segment of hook-and-loop material fixed along its entire length to said back face of said container back wall between said strap fixed end and said point whereby, when said segments of hook-and-loop material are mated with the segment of the garment disposed therebetween over a portion of said lengths thereof, said container is immobilized in relation to the garment.

19. A pouch according to claim 18 further comprising means for sealing at least a portion of said open top edge so as to secure the objects inserted therein.

* * * * *